US009303910B2

(12) United States Patent
Villalobos et al.

(10) Patent No.: US 9,303,910 B2
(45) Date of Patent: Apr. 5, 2016

(54) APPARATUS FOR FORMING A FROZEN LIQUID PRODUCT

(71) Applicant: Arctico Holdings, LLC, Miami, FL (US)

(72) Inventors: Nestor Villalobos, Miami, FL (US); Paul E. Skelton, Kansas City, MO (US); Justin D. Eakes, Blue Springs, MO (US); Bruce A. Wardlow, Lee's Summit, MO (US); James Costa, Danbury, CT (US); Louis Imbrogno, Marco Island, FL (US)

( * ) Notice: Subject to any disclaimer, the term of this patent is extended or adjusted under 35 U.S.C. 154(b) by 446 days.

(21) Appl. No.: 13/887,871

(22) Filed: May 6, 2013

(65) Prior Publication Data

US 2014/0238068 A1 Aug. 28, 2014

Related U.S. Application Data

(60) Provisional application No. 61/767,813, filed on Feb. 22, 2013.

(51) Int. Cl.

| | |
|---|---|
| ***F25C 1/22*** | (2006.01) |
| ***F25C 1/24*** | (2006.01) |
| ***B28B 7/00*** | (2006.01) |

(52) U.S. Cl.

CPC ..... *F25C 1/22* (2013.01); *B28B 7/0079* (2013.01); *F25C 1/24* (2013.01)

(58) Field of Classification Search

CPC ..... F25C 1/22; F25C 1/24; F25C 1/243; F25C 2400/06; F25C 2400/00; B28B 7/24; B28B 7/26; B28B 7/241; B28B 7/0079

USPC ..... 62/340; 249/60, 203, 118, 119, 121, 249/123, 139, 154, 165–172

See application file for complete search history.

(56) References Cited

U.S. PATENT DOCUMENTS

| | | | |
|---|---|---|---|
| 2,235,964 | A | 3/1941 | Meyer et al. |
| 2,618,130 | A | 1/1952 | Leichtman et al. |
| 2,939,299 | A | 6/1960 | Sherbicom |
| 3,491,907 | A | 1/1970 | Eelkema |
| 4,244,470 | A | 1/1981 | Burnham |
| 4,287,941 | A | 9/1981 | Allen |
| D267,994 | S | 2/1983 | Luzich |
| 4,562,991 | A | 1/1986 | Wu |
| 4,783,042 | A | 11/1988 | Folkmar |

(Continued)

OTHER PUBLICATIONS

Ice Rocks Brand Advertisement.

*Primary Examiner* — James Sanders
*Assistant Examiner* — Leith S Shafi
(74) *Attorney, Agent, or Firm* — Malloy & Malloy; John R. Fulton; Jason LaCosse

(57) ABSTRACT

An apparatus for forming a frozen liquid product into a predetermined shape, such as a spherical or ball-shape, includes a body (or "housing") comprising first and second sections relatively disposable into an open or closed orientation, through connection by an attachment assembly. A securing structure is associated with the attachment assembly and operative to maintain the first and second sections in the closed orientation concurrently to the securing structure being disposed in fluid sealing disposition to a hollow interior of the body. A single use connector removably connects the securing structure into the fluid sealing relation as it maintains the first and second sections in the closed orientation.

19 Claims, 3 Drawing Sheets

(56) References Cited

U.S. PATENT DOCUMENTS

| | | | |
|---|---|---|---|
| 4,804,083 | A | 2/1989 | Weeks |
| 4,813,646 | A | 3/1989 | Fujio |
| 4,831,840 | A | 5/1989 | Fletcher |
| 4,899,976 | A | 2/1990 | Cederroth et al. |
| 4,979,370 | A | 12/1990 | Hotaling |
| 5,157,929 | A | 10/1992 | Hotaling |
| 5,393,032 | A | 2/1995 | Cederroth |
| 5,618,463 | A | 4/1997 | Rindler et al. |
| 5,806,710 | A | 9/1998 | Shiffer et al. |
| 5,958,481 | A | 9/1999 | Hodges |
| 6,038,869 | A | 3/2000 | Lee et al. |
| 6,112,548 | A | 9/2000 | Moenickheim |
| 6,461,653 | B1 | 10/2002 | Cox |
| D475,288 | S | 6/2003 | Hoffmann et al. |
| 6,647,743 | B2 | 11/2003 | Moore |
| 6,857,277 | B2 | 2/2005 | Somura |
| 6,935,124 | B2 | 8/2005 | Takahashi et al. |
| 7,093,816 | B2 | 8/2006 | Lacan et al. |
| D536,611 | S | 2/2007 | Peck |
| 7,413,596 | B2 | 8/2008 | Platow et al. |
| 7,900,471 | B2 | 3/2011 | Leske |
| D654,759 | S | 2/2012 | Browning et al. |
| 2006/0049328 | A1 | 3/2006 | Vangedal-Nielsen |
| 2007/0107447 | A1 | 5/2007 | Langlotz |
| 2011/0209483 | A1 | 9/2011 | Hall et al. |
| 2013/0186113 | A1 | 7/2013 | Chung et al. |

APPARATUS FOR FORMING A FROZEN LIQUID PRODUCT

CLAIM OF PRIORITY

The present application is based on and a claim to priority is made under 35 U.S.C. Section 119(e) to provisional patent application in the U.S. Patent and Trademark Office, having Ser. No. 61/767,813 and a filing date of Feb. 22, 2013, the entirety of which is incorporated herein by reference.

BACKGROUND OF THE INVENTION

1. Field of the Invention

The present invention is directed to an apparatus for freezing liquids. More in particular, the invention is directed to a containment structure configured to temporarily receive and contain an amount of a freezable liquid. The apparatus is further structured to release the contained frozen liquid (ice) subsequent to freezing. The present invention is preferably structured for single use such that it is rendered inoperable upon opening and release of the contained ice product. As such, the present invention represents a significant step forward in the art by facilitating convenient and sanitary formation of high quality consumable ice, in various forms, for individual use. If desired, the interior of the apparatus can be further structured to impart embossed and/or embedded aesthetic designs, logos, or other indicia onto the surface of the contained ice product.

2. Description of the Related Art

The formation and use of ice balls for cooling of food and beverages is well known in general. However, despite some evolution in the specific manner in which such ice balls are formed, the current art is lacking in the aspect of sanitary formation of such frozen products. There are also certain other aspects of producing, storing, and/or transporting such products which are not adequately addressed in the art.

For example, existing spherical ice ball molds are typically reusable and made with rubber, silicone, or low cost plastic parts. These products are typically intended for home use, and are also marketed as multi-use, reusable, and sometimes washable molds. Basically, the consumer fills the container with water, places the filled container in the freezer, and several hours later the ice product, sometimes spherical in nature, is ready for use.

The challenges with these existing products are several. First, the structure of such molds makes it cumbersome and challenging to remove the ice. Second, the product is intended to use tap water or perhaps bottled water, which often has a certain taste and forms at least partially opaque/generally cloudy ice balls. Third, sanitary issues arise due to the difficult nature of cleaning such reusable molds, which can host a number of pathogens if not appropriately decontaminated.

It would therefore be beneficial to provide a simple to use apparatus that facilitates the forming of a consumable frozen ice product. It would also be significantly advantageous for such a device to permit cost effective mass production and use. It would be a further advantage for such an apparatus to provide consistently safe and sanitary formation of consumable ice, while avoiding the pitfalls of contamination, tampering, etc., that are not yet appropriately addressed in the art.

SUMMARY OF THE INVENTION

The present invention is directed to an apparatus for forming a frozen liquid product into a predetermined shape such as, but not necessarily limited to, the substantially spherical shape of an "ice ball". As such, the resulting frozen liquid product can be used to cool beverages, other food items and/or for a variety of cooling applications. As set forth in greater detail hereinafter, at least some of the preferred embodiments of the present invention include a structuring of the forming apparatus as a single use device. In such an application, the resulting frozen liquid product may find its primary use in the cooling of premium beverages either in a commercial environment such as a restaurant, cocktail lounge, etc. or a domestic environment. Accordingly, a plurality of this type of forming apparatus may be concurrently stored in a reduced temperature environment sufficient to maintain the liquid product in a frozen state.

Therefore, at least one preferred embodiment of the forming apparatus of the present invention comprises a body including a first section and a second section relatively disposable in an open orientation and a closed orientation. Moreover, when the body is in the closed orientation, an attachment assembly serves to removably but securely connect the first and second sections to one another. As a result, the closed orientation comprises the body having a hollow interior configured to substantially correspond to the predetermined shape of the formed frozen liquid product. In this preferred embodiment, the spherical or "ice ball" configuration of the frozen product would result in the corresponding dimension and configuration of each of the first and second sections having a hemispherical configuration.

When both the first and second sections assume the substantially corresponding hemispherical configurations, each includes an open end. The aforementioned attachment assembly may be at least partially defined by cooperative structuring of the peripheral portions of the opened ends of each hemispherical first and second section. Such a peripheral construction may be in the form of a threaded connection, press fit connection, snap fit connection or other appropriate connection which serves to establish and maintain the first and second section in the closed orientation. Concurrently, the peripheral construction and the attachment assembly associated therewith is structured to prevent leakage of liquid, prior to freezing, from the hollow interior of the body.

Additional features of the forming apparatus include the provision of a securing structure which may be operatively and structurally associated with the attachment assembly to removably but reliably maintain the first and second sections in the closed orientation. In addition, the securing structure is removably disposable into fluid sealing relation with said hollow interior of the body, at least when the first and second sections are in the closed orientation. This fluid sealing disposition of the securing structure may further facilitate a single use of the frozen liquid product forming apparatus. More specifically, a single use connector may be disposed and structured to removably connect the securing structure in fluid sealing relation with the hollow interior of the body, when in the closed orientation. In even more specific terms, the body may include at least one port disposed in fluid communication between the interior and exterior of the hollow interior of the body. If left open, the port would prevent the complete filling of the hollow interior body with liquid. Therefore, the single use connector serves to initially and/or originally maintain the securing structure in sealing relation to the port during the original formation and/or filling of the body of the apparatus. However, sealing of the one port by the securing structure will prevent leakage of liquid there through before and after the body being filled and at least until the liquid on the interior of the body is frozen.

Moreover, the single use connector may be disposed on the body to maintain the securing structure in a locking relation to the attachment assembly and in interconnecting relation to peripheral portions of the hemispherical or other shaped, first and second sections. The "single use" structuring of the connector may include it being destructively connected to the body in interconnecting relation between the securing structure and adjacent or contiguous portions of the body. Therefore, the term "destructively connected" may be defined by the single use connector comprising a detachable heat seal or may be at least partially defined by a weakened or frangible junction or seam extending about a portion of the periphery of the securing structure and serving to interconnect it to a contiguous portion of the body.

Accordingly the removable and/or destructive connector associated with the securing assembly will serve to effect a locked but removable connection of the attachment assembly to maintain the first and second sections in the closed orientation. However, when the securing structure is selectively disposed in a released position, the repeated use or replacement of the securing member, in the aforementioned sealing or locking relation, will be prevented due to the destruction of the interconnection of the single use connector with the remainder of the body.

Other structural and operative features of one or more preferred embodiments of the forming apparatus of the present invention include the provision of a fill hole formed in the body in an appropriate location to facilitate substantially complete or an at least predetermined partial filling of liquid into the hollow interior of the body. In cooperation therewith, a closure in the form of a plug, cap, crown, etc., may be removably disposed in covering, closing and/or sealing relation to the fill hole. In order to prevent damage to the forming apparatus during the freezing process, the hollow interior of the body may be substantially, but not completely filled thereby leaving an expansion area adjacent to the fill hole or other appropriate location within the hollow interior of the body. In the alternative, the closure may in fact serve as a "freeze plug" which, upon excessive expansion or over filling of the liquid within the interior of the body, the closure will be dislodged allowing additional, at least minimal but adequate expansion of the liquid as it is being frozen.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As represented in the accompanying Figures, the present invention is directed to an apparatus generally indicated as 10 for forming a frozen product into a predetermined shape or configuration. As explained in greater detail hereinafter, a variety of individual liquids or mixtures thereof may be frozen into the intended shape. The composition of the liquid to be frozen may include, but not be limited to, water, purified water, soda, CSDs, juices, dairy, coffee, tea, gelatins, puddings, cosmetic liquids, or other liquid compositions, wherein in the resulting frozen product is safe and appropriate to come into direct contact with a consumable beverage or other food product, or a human subject. Moreover, in cooling applications, the dimension of the frozen liquid product should be such as to facilitate placement in a drinking or other type of container in direct heat transferring relation with the substance to be cooled.

Figure 5:
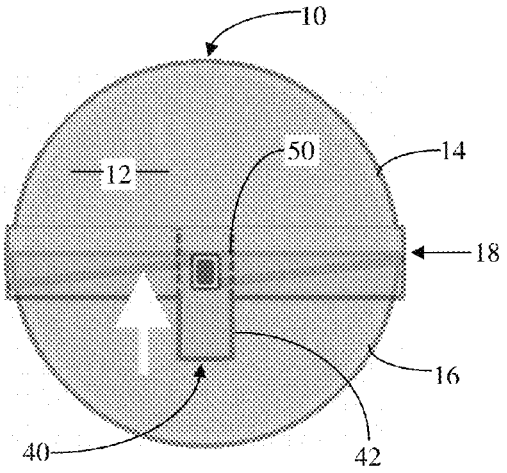
FIG. 5 is a front view in schematic form of the embodiment of FIGS. 1 through 4A.
Figure 6:
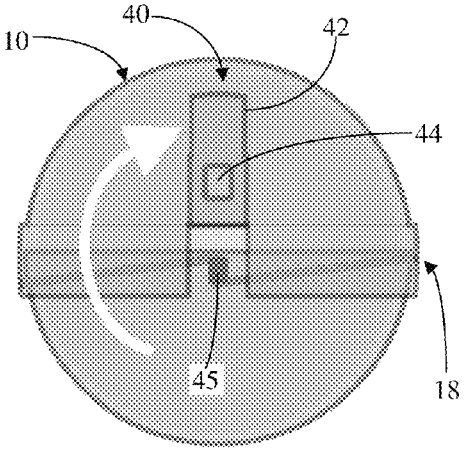
FIG. 6 is a front view in schematic form of the embodiment of FIG. 5 in at least a partially open orientation.

Accordingly, the forming apparatus 10 includes a body generally indicated as 12 having a first section 14 and second section 16. The first and second sections 14 and 16 are relatively moveable and/or positionable into either a closed orientation, as represented in FIGS. 5 and 6, or an open orientation, as represented in FIGS. 1 through 4 and 7. When in the closed orientation, an attachment assembly, generally indicated as 18, serves to removably connect and maintain the first and second sections 14 and 16 attached to one another especially, but not exclusively, during and after the freezing process, until it is desired to use the frozen liquid product. Also, when the first and second sections 14 and 16 are disposed in the closed orientation, the body 12 comprises a substantially hollow interior having a dimension and configuration corresponding to the frozen liquid product 100 to be formed.

With further regard to the predetermined shape of the resulting frozen liquid product 100, at least one preferred embodiment comprises the first and second sections 14 and 16 each being formed into correspondingly dimensioned and configured hemispheres. As such, each of the hemispherical first and second sections 14 and 16 include an open end as at 14' and 16' respectively, having a substantially continuous peripheral portion surrounding the open ended construction. Therefore, additional structural features of at least one preferred embodiment include the aforementioned attachment assembly 18 being formed and/or mounted on and extending along both of the peripheral portions of the open ends 14' and 16'.

Moreover, the attachment assembly 18 may comprise a substantially threaded configuration or structure as represented in FIGS. 1-7. When such a threaded construction is used, the joining and separation of the first and second sections 14 and 16 may be accomplished by a relative rotation thereof, indicated by directional arrows 102 and 102' in FIG. 7. Such relative rotational movement serves to accomplish a screw-on 102 liquid sealing connection and a screw-off 102' disconnection of the first and second sections 14 and 16, as schematically indicated. While not specifically represented, alternatives of the attachment assembly 18 may comprise a telescopically engaging press fit or friction fit, as well as ancillary latch components, tear strip components, etc. As such, the peripheral portions of the corresponding open ends 14' and 16' may be forced together in mating relation to one another. When this structural modification is utilized, the corresponding dimensions of the peripheral portions of the open ends 14' and 16' are such as to securely but removably accomplish the fluid sealing attachment of the first and second sections 14 and 16 along the corresponding peripheral portions of the open ends 14' and 16'.

As represented in FIGS. 1 through 4, whether or not the above noted threaded attachment assembly 18 is utilized, the exterior surfaces about the peripheral portions of the open ends 14' and 16' include a gripping structure 20 may be included on at least one, but preferably both of the first and second sections 14 and 16. In at least one embodiment, the gripping structure comprises a roughened, ribbed, irregular and/or generally non-smooth portion 22 and 24 protruding outwardly from the remainder of the exterior surface of the first and second sections 14 and 16, respectively. As also represented, the gripping portions 22 and 24 are disposed adjacent or contiguous to the peripheries of the open ends 14' and 16'. As a result, the gripping portions 22 and 24 may be easily and firmly grasped by opposite hands of a user resulting in a more effective gripping to facilitate the relative rotation 102, 102' or other relative movement of the first and second sections 14 and 16 during the connection or disconnection thereof. Further with regard to the embodiments of FIGS. 1 through 4 additional structural features include a base 28 fixedly, integrally or removably disposed on the exterior surface of at least one of the first and second sections, as at second section 16. The base 28 may assume a variety of different decorative and/or operative configurations which are sufficient to facilitate a stable positioning and maintenance of the body 12 in an intended, upright position. As noted, the base 28' in FIG. 4A may vary in dimension and configuration from the base 28 represented in FIGS. 1 through 4 by comprising a more curved configuration, thereby possibly enhancing the decorative appearance of the forming apparatus 10. In addition, either or both of the bases 28 and 28' may be otherwise shaped and configured to correspond to other portions of the body 12 so as to facilitate a stacking orientation thereof of a plurality of the bodies 12. By way of example, a plurality of the bodies 12 may be effectively stored in a reduced temperature environment, in a stacked orientation, during and after the freezing process. Similarly and prior to filling, a plurality of the bodies 12 may be disposed in a stacked orientation during initial manufacture, transportation, distribution, etc., before being used.

As best represented in the schematic representation of FIGS. 1-4A, the body 12 of one or more of the embodiments of the forming apparatus 10 may include at least one fill hole 30 located in one of the first or second sections, such as in first section 14. The fill hole 30 is dimensioned and disposed to facilitate filling of the hollow interior of the body 12 substantially entirely or at least to a filling level sufficient to accommodate expansion of a liquid when subjected to the freezing process. In a further embodiment, the fill hole 30 may also comprise a "fill neck" configuration protruding from a portion of the body 12. In cooperation therewith, a closure 32 may be in the form of a plug, cap, crown, or other appropriate structure. The closure 32 is correspondingly and/or appropriately dimensioned and configured with the fill hole 30 to accomplish a fluid tight and/or air tight seal with the fill hole 30. Therefore, any inadvertent escape or leakage of liquid and/or air from the hollow interior of the body 12, through the fill hole 30, after completion of the filling process and prior to freezing will be restricted. In a further embodiment, at least a portion of the exterior of the closure 32 can be structured to form a decorative shape or informative indicia, logo, marking, etc. It is also within the scope and intent of the present invention that the closure 32 can comprise a variety of shapes and sizes.

Figure 8:
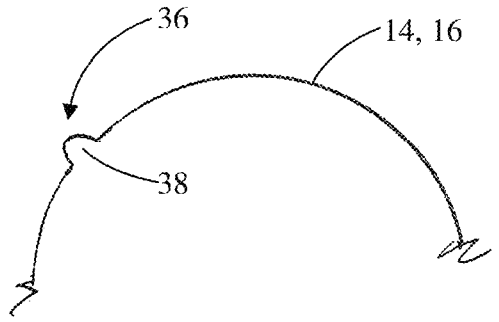
FIG. 8 is a schematic representation in partial cutaway disclosing one embodiment of a marking structure which may be associated with the forming structure of the embodiment of FIGS. 1-7.
Figure 9:
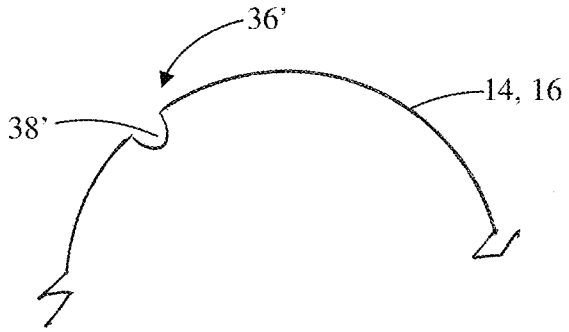
FIG. 9 is a schematic representation in partial cutaway disclosing an additional embodiment of a marking structure which may be associated with the forming structure of the embodiment of FIGS. 1-7.

Additional structural and operative features of at least one preferred embodiment of the forming apparatus 10 are represented in FIGS. 8-9 and include a marking structure, generally indicated as 36, disposed and structured to form a decorative or informative indicia, logo, marking, etc. The marking structure 36 may be formed on either one or both of the first and second sections 14 and 16. More specifically, in the embodiment of FIG. 8, the marking structure 36 includes an open interior 38 disposed in direct fluid communication with the hollow interior of the body 12 and as such is dimensioned and disposed to receive liquid therein, from the hollow interior of the body 12, prior to the liquid being frozen. Thus, when the liquid and the body 12 is subjected to a reduced temperature environment to accomplish freezing of the liquid, the liquid within the open interior 38 will freeze accordingly and thereby form a mark or indicia on (and projecting outwardly from) the exterior surface of the frozen liquid product. This mark or indicia will be clearly observable and may be in the form of any type of alpha-numeric, pictorial, design, icon, logo, etc. which corresponds to the dimension and configuration of the marking structure 36 and interior 38 in which the mark or indicia is formed as the liquid contained within the interior is frozen.

In another embodiment, the marking structure 36' can extend or protrude inwardly into the hollow interior of the body 12, wherein the corresponding interior 38' of the marking structure 36' may be open and exposed to the exterior of the body 12. Further, in this embodiment, the marking structure 36' may have a substantially solid or closed construction, thereby effectively eliminating the open interior 38'. In either of these structural modifications, the inward projection of the marking assembly 36' will serve to facilitate it being embedded in the frozen liquid product as it is frozen. Thus, upon removal of the frozen liquid product in the predetermined shape, from the interior of the body 12, the resulting mark, indicia, etc. will be effectively embossed within the exterior surface of the frozen liquid product. In a still further embodiment, a "sleeve" or similar type of separately inserted component can be appropriately positioned into the hollow interior of the body 12 to achieve a desired marking.

Figure 7:
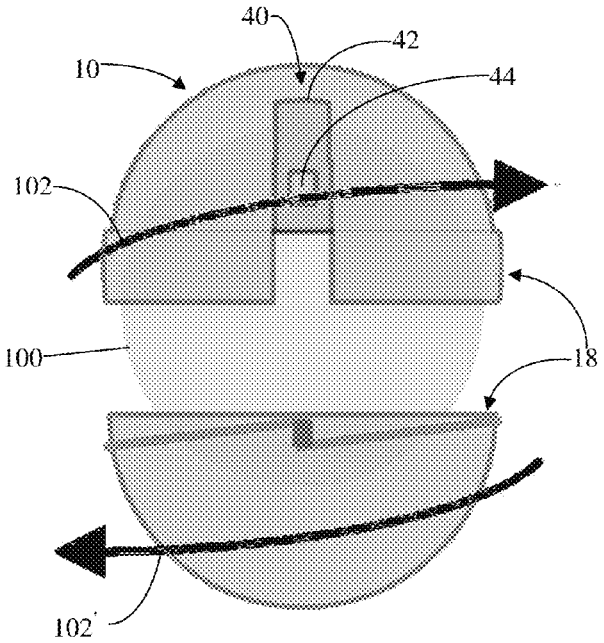
FIG. 7 is a front view in schematic form of the embodiments of FIGS. 5 and 6 in a fully opened orientation.

With primary reference to FIGS. 5, 6 and 7, yet another structural and operative feature of the present invention is the provision of the securing structure generally indicated as 40. The securing structure 40 may include one or more securing members 42 in the form of a tab(s) mounted on or connected to one of the first and second sections, as at 14. In addition, the securing structure 40 is cooperatively disposed and structured with the attachment assembly 18 so as to maintain the first and second sections 14, 16 in the closed orientation when the one or more securing members 42 are disposed in an operative, locking orientation relative to the attachment assembly 18. Moreover, in the embodiments of FIGS. 5 through 7 the attachment assembly 18 comprises an outwardly projecting member or portion 44 integrally or otherwise fixedly secured in direct cooperative relation to the attachment assembly 18 and in registry with the securing structure 40.

More specifically, in this embodiment the one or more securing members 42 includes an opening or aperture 45 which is disposed in cooperation with the projection 44 so as to facilitate its passage through the opening 45 when the securing structure 40 is in the locking, position of FIG. 5 relative to the attachment assembly 18. In other embodiments, the securing structure 40 and/or securing members 42 can comprise one or more frangible tear strips disposed in various orientations, including circumferential or partially circumferential orientations that are substantially perpendicular to that shown in the present Figures.

Moreover, one or more preferred embodiments of the forming assembly 10 and body 12 include the provision of a connector generally indicated as 50. Preferably, the connector 50 is a single-use connector which serves to interconnect the securing structure 40, including the one or more securing members 42, in a locking orientation relative to the attachment assembly 18. The single use capabilities or features of the connector 50 include it being "destructively attached" in interconnecting relation between the securing structure 40, or the securing member(s) 42, and one or both of the first and second sections 14, 16 of the body 12, such as adjacent the peripheral portions of the open ends 14' and 16'. Such a destructible connecting structure of the connector 50 allows selective positioning of the securing structure 40 from the locking position of FIG. 5 to the open or disengaging position of FIGS. 6 and 7. When so positioned, the destructible nature of the connector 50, as set forth above, becomes broken, detached or sufficiently destroyed to be inoperable. By way of example, such inoperability can include, but is not limited to, an inability to restrict flow of liquid, an inability to create a fluid or air tight seal, an inability to attach or connect, etc. As a result, the securing structure 40 and securing member 42 cannot be re-used or re-positioned in locking engagement with the attachment assembly 18. As indicated above, the term "destructively connected" or its equivalent as used herein, may include, but is not limited to, the single use connector 50 comprising a detachable heat seal or a weakened or frangible junction or seam extending about a portion of the periphery of the securing member(s) 42 and serving to interconnect it to a contiguous portion of the body 12.

The single use feature of the forming structure 10 is further facilitated by the provision of least one port 52 formed in the body or housing 12 in fluid communication with the hollow interior of the housing, at least when the first and second sections 14 and 16 are in the closed orientation. As indicated above, the securing structure 40 comprises at least one securing member 42, which is disposed in fluid sealing relation to the at least one port 52, at least when said first and second sections are in said closed orientation and the securing structure 40 is in locking engagement with the attachment assembly 18. The provision of the single use connecting structure 50 being structured to removably but destructively connect the at least one securing member 42 in the locking relation to the attachment assembly 18 also serves to maintain the securing structure 40 in sealing relation to the port 52. Further, the destructive nature of the connecting structure 50, as set forth above, will prevent the securing structure 40 and the at least one securing member 42 from being repeatedly disposed in the sealing relation with the port 52.

Figure 1:
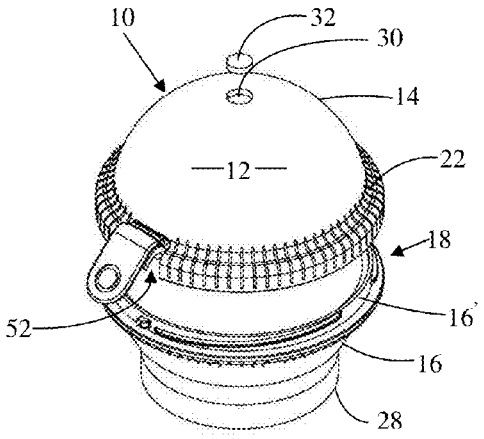
FIG. 1 is a perspective view of one preferred embodiment of the forming apparatus of the present invention.
Figure 2:
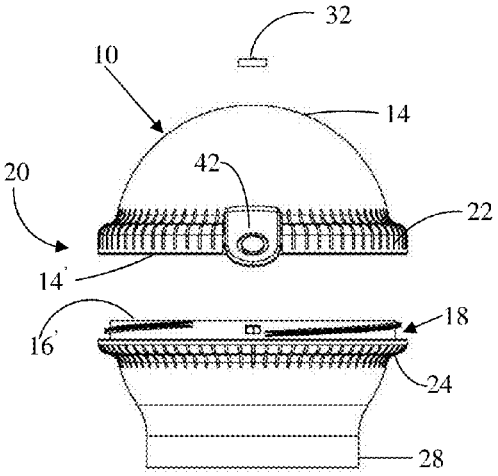
FIG. 2 is a front view of the embodiment of FIG. 1.
Figure 3:
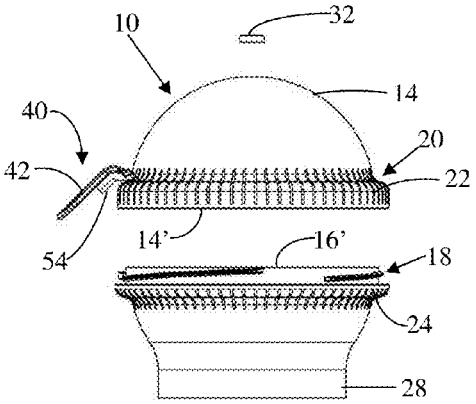
FIG. 3 is a side view of the embodiment of FIGS. 1 and 2 in an open orientation.
Figure 4:
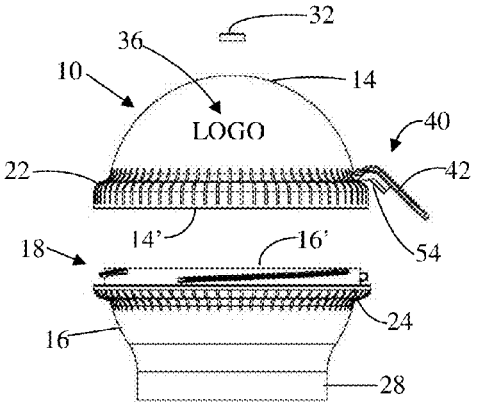
FIG. 4 is an opposite side view from that of FIG. 3.
Figure 4A:
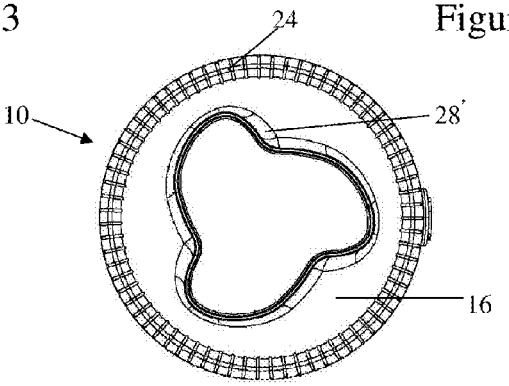
FIG. 4A is a bottom view of another embodiment of the forming apparatus.

In order to facilitate the sealing of the port 52 by the at least one securing member 42, a sealing plug 54 may be fixedly and/or integrally secured to the underside or other appropriate portion of the securing member 42, as represented in FIGS. 3 and 4. It should be apparent the more than one port 52 may be formed on the body 12 in fluid communication with the interior of the body 12. With such a structural modification, a corresponding number of securing members 42 may be correspondingly disposed and cooperatively structured to accomplish a sealing of each of the plurality of ports, at least when the first and second sections 14 and 16 are in the closed orientation.

In use, the body 12 of the forming apparatus 10 will normally be supplied to a user in the closed orientation, wherein the securing structure 40 is disposed and removably maintained in locking relation with the attachment assembly 18 and sealing relation with the port 52, by the single use connecting structure 50. In some embodiments, the closure can initially be removably stored in the fill hole 30. In such embodiments, the user will remove the closure 32 from the fill hole 30 and then at least partially fill the interior of the body 12 with the liquid to be frozen. In embodiments where an automated filling and/or sealing process is utilized, such as in a bottling line scenario, the fill hole 30 and closure 32 can be optimally configured for such use. After receiving the liquid to be frozen, the closure 32 will then be placed in sealing/closing relation to the fill hole 30, and the body 12 will be placed in a reduced temperature environment for freezing the added liquid into the frozen liquid product 100, which corresponds to the configuration of the interior of the body 12. When the frozen product 100 is intended for use, the first and second sections 14 and 16 are disposed into the open orientation and thereby separated at least a sufficient amount to remove the frozen product 100 from the interior of the body, as schematically represented in FIG. 8.

The inventive forming apparatus 10 can be formed from a variety of suitable materials in a variety of sizes, shapes, and colors suitable for the aforementioned intended uses. For instance, the forming apparatus 10 can comprise a plastic material of construction formed of any number of appropriate plastics, including see-through plastics, translucent plastics, "cloudy" plastics, and/or opaque plastics, in some such embodiments. The forming apparatus can also comprise a variety of other materials, including, but not limited to, metals, paper-based products, composites, recycled materials, glow in the dark materials, iridescent materials, phosphorescent materials, etc. Accordingly, the forming apparatus 10 can be made using a variety of appropriate manufacturing techniques including, but not limited to, blow molding, injection molding, etc.

Typical dimensions of the forming apparatus 10 will generally be in the range of one inch (1") to three inches (3") in diameter, but are not strictly limited to this size range. Indeed, a variety of other size ranges are contemplated to be within the scope and intent of the present invention, which may be suitable to particular applications.

Since many modifications, variations and changes in detail can be made to the described preferred embodiment of the invention, it is intended that all matters in the foregoing description and shown in the accompanying drawings be interpreted as illustrative and not in a limiting sense. For instance, although the primary applications discussed herein are directed to use of the inventive apparatus 10 to form ice products for cooling beverages, it is within the scope and intent of the present invention that the forming apparatus can be used to form directly consumable products, including, but not limited to, dairy, gelatins, pudding, etc., as well as safe, non-consumable products such as cosmetic liquids, etc. Thus, the scope of the invention should be determined by the appended claims and their legal equivalents.

What is claimed is:

1. An apparatus for forming a frozen liquid product into a predetermined shape, said apparatus comprising:

a housing including a first section and a second section relatively disposable into an open orientation and a closed orientation, an attachment assembly formed on said housing and structured to removably connect said first and second sections into said closed orientation, a securing structure disposable into and out of fluid sealing relation with an interior of said housing, at least when said first and second sections are in said closed orientation, said securing structure is cooperatively structured with said attachment assembly to maintain said first and second sections in said closed orientation, said securing structure includes at least one securing member disposed into engagement with at least a portion of said attachment assembly and concurrently into said fluid sealing relation with said interior of said housing, at least one port formed in said housing in fluid communication with said interior of said housing; said at least one securing member disposed in said fluid sealing relation to said at least one port, at least when said first and second sections are in said closed orientation, a single use connecting structure disposed and structured to removably connect said at least one securing member in said fluid sealing relation to said at least one port, said closed orientation comprising said first and second sections disposed to collectively retain liquid within said interior of said housing before, during and after a freezing process, and said open orientation comprising sufficient separation of said first and second sections to facilitate removal of the frozen liquid product from said housing in the predetermined shape.

2. An apparatus as recited in claim 1 wherein said single use connecting structure further disposed and structured to removably and destructively connect said at least one securing member in said fluid sealing relation to said at least one port.

3. An apparatus as recited in claim 1 wherein each of said first and second sections comprises a substantially commonly dimensioned, hemispherical configuration collectively defining a substantially spherical configuration of said housing interior, said housing interior substantially corresponding to the predetermined shape of the frozen liquid product, when said first and second sections are in said closed orientation.

4. An apparatus as recited in claim 3 wherein each of said hemispherical first and second sections comprises an open end, said attachment assembly disposed substantially adjacent a peripheral portion of each of said open ends.

5. An apparatus as recited in claim 4 wherein said securing structure is disposed in locking engagement with said attachment assembly and in interconnecting relation between said peripheral portions of said first and second sections.

6. An apparatus as recited in claim 5 further comprising a single use connector removably and destructively connecting said securing structure in said locking engagement with said attachment assembly and in said fluid sealing relation with said housing interior.

7. An apparatus as recited in claim 1 further comprising at least one fill opening formed in said housing in fluid communication with said housing interior; a closure disposable into fluid sealing relation to said at least one fill opening.

8. An apparatus as recited in claim 1 further comprising a marking structure disposed in said housing and structured to form a correspondingly configured, observable mark on an exterior of said frozen liquid product.

9. An apparatus as recited in claim 8 wherein said marking structure comprises an at least partially open interior and an outwardly protruding disposition relative to an exterior surface of said housing, said open interior dimensioned and configured to contain liquid therein during the freezing process, said correspondingly configured mark protruding outwardly from an exterior of the frozen liquid product and being at least partially defined by frozen liquid within said open interior.

10. An apparatus as recited in claim 8 wherein at least a portion of said marking structure extends inwardly from an interior surface of said housing interior into substantially embedded relation to exterior surface of the frozen liquid product.

11. An apparatus as recited in claim 1 further comprising a base secured to an exterior of said housing, said base disposed and structured to maintain said housing in a substantially stable, upright orientation.

12. An apparatus for forming a frozen liquid product into a predetermined shape, said apparatus comprising:

a housing including a first section and a second section relatively disposable into an open orientation and a closed orientation, said closed orientation comprising said housing having a hollow interior configured to substantially correspond to the predetermined shape of the frozen liquid product, an attachment assembly formed on said housing and structured to removably connect said first and second sections in said closed orientation, said securing structure includes at least one securing member disposed into engagement with at least a portion of said attachment assembly and concurrently into a fluid sealing relation with said hollow interior of said housing, at least one port formed in said housing in fluid communication with said hollow interior of said housing; said at least one securing member disposed in fluid sealing relation to said at least one port, at least when said first and second sections are in said closed orientation, a single use connecting structure disposed and structured to removably connect said at least one securing member in said fluid sealing relation to said at least one port, a securing structure cooperatively disposed and structured with said attachment assembly to maintain said first and second sections in said closed orientation, said closed orientation comprising said first and second sections collectively disposed in retaining relation to liquid within said hollow interior of said housing, at least before, during and after a freezing process, and said open orientation comprising a sufficient separation of said first and second sections, at least along said attachment assembly, to facilitate removal of the frozen liquid product from said hollow interior of said housing in the predetermined shape.

13. An apparatus as recited in claim 12 wherein said securing structure is removably disposable into fluid sealing relation with said hollow interior at least when said first and second sections are in said closed orientation.

14. An apparatus as recited in claim 13 further comprising a single use connector disposed and structured to removably connect said securing structure in said fluid sealing relation with said hollow interior.

15. An apparatus as recited in claim 12 wherein said at least one port formed in said housing fluid communication between an exterior and interior of said housing.

16. An apparatus as recited in claim 15 wherein said securing structure is disposed in removable, locking engagement with said attachment assembly.

17. An apparatus as recited in claim 16 wherein said single use connecting structure disposed and structured to removably and destructively connect said securing structure in said fluid sealing relation to said at least one port and concurrently in said removable, locking engagement with said attachment assembly.

18. An apparatus as recited in claim 12 wherein each of said first and second sections comprises a substantially commonly dimensioned, hemispherical configuration collectively defining a substantially spherical configuration of said housing interior and the predetermined shape of the frozen liquid product, when said first and second sections are in said closed orientation.

19. An apparatus as recited in claim 12 further comprising a gripping structure formed on both of said first and second sections, each of said gripping structures including a generally non-smooth portion protruding outwardly from a remainder of the exterior surface of the first and second sections, substantially adjacent a periphery of and open end thereof.

* * * * *